US006634429B2

(12) United States Patent
Henderson et al.

(10) Patent No.: US 6,634,429 B2
(45) Date of Patent: Oct. 21, 2003

(54) UPPER ZONE ISOLATION TOOL FOR INTELLIGENT WELL COMPLETIONS

(75) Inventors: William David Henderson, Tioga, TX (US); Travis Wayne Cavender, Angleton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/932,188

(22) Filed: Aug. 17, 2001

(65) Prior Publication Data

US 2003/0019634 A1 Jan. 30, 2003

Related U.S. Application Data

(60) Provisional application No. 60/229,230, filed on Aug. 31, 2000.

(51) Int. Cl.[7] ..... E21B 34/00

(52) U.S. Cl. ..... 166/332.1; 166/278; 166/373

(58) Field of Search ..... 166/278, 373, 166/378, 380, 51, 52, 313, 332.1

(56) References Cited

U.S. PATENT DOCUMENTS

| | | | | |
|---|---|---|---|---|
| 3,696,868 A | | 10/1972 | Taylor, Jr. | |
| 3,735,827 A | | 5/1973 | Berryman | |
| 3,796,261 A | | 3/1974 | Nutter | |
| 3,963,076 A | | 6/1976 | Winslow | |
| RE29,638 E | * | 5/1978 | Nutter | 166/128 |
| 4,253,522 A | | 3/1981 | Setterberg, Jr. | |
| 4,603,742 A | | 8/1986 | Wong et al. | |
| 4,796,708 A | * | 1/1989 | Lembcke | 166/386 |
| 4,944,351 A | * | 7/1990 | Eriksen et al. | 166/376 |
| 5,044,443 A | * | 9/1991 | Churchman et al. | 166/386 |
| 5,070,941 A | * | 12/1991 | Kilgore | 166/98 |
| 5,156,207 A | | 10/1992 | Haugen et al. | |
| 5,957,208 A | | 9/1999 | Schnatzmeyer | |

* cited by examiner

*Primary Examiner*—Frank Tsay
(74) *Attorney, Agent, or Firm*—Peter V. Schroeder

(57) ABSTRACT

Improved methods and apparatus for isolating and opening a subterranean zone in a multiple zone well. An isolation tool is installed in the well with a tubing string accessing a particular zone. The tool can be remotely opened and closed to provide access to the zone either mechanically or by applying pressure variation sequences to the tool.

24 Claims, 6 Drawing Sheets

UPPER ZONE ISOLATION TOOL FOR INTELLIGENT WELL COMPLETIONS

PRIORITY CLAIM

This application claims the benefit of U.S. Provisional Application No. 60/2000-1810PCT filed on Aug. 16, 2001, entitled UPPER ZONE ISOLATION TOOL FOR SMAT WELL COMPLETIONS and 60/229,230 filed Aug. 31, 2000, entitled UPPER ZONE ISOLATION TOOL FOR SMART WELL COMPLETIONS.

TECHNICAL FIELD

This invention relates to improved methods and apparatus for completing, producing and servicing wells, and in particular to improved methods and apparatus for separately isolating and treating multiple hydrocarbon bearing subterranean zones in a well. The methods and apparatus of the present invention are applicable to isolating well zones for treatment production, testing, completion and the like.

BACKGROUND OF THE INVENTION

It is common to encounter hydrocarbons wells intersecting more than one separate subterranean hydrocarbons bearing zones. These separate zones can have the same or different characteristics. Production of hydrocarbons from subterranean zones can be enhanced by performing various treatments to the zones. Examples of well treatments include fracturing, perforating, gravel packing, chemical treatment, and the like. The zone's particular characteristics determine the ideal treatments to be used. In multi zone wells, different well treatments may be required to properly treat the zones.

For example, the production of hydrocarbons from unconsolidated or poorly consolidated formation zones may result in the production of sand along with the hydrocarbons. The presence of formation fines and sand is disadvantageous and undesirable in that the particles abrade pumping and other producing equipment and reduce the fluid production capabilities of the producing zones in the wells. Particulate material (e.g., sand) may be present due to the nature of a subterranean formation and/or because of well stimulation treatments wherein proppant is introduced into a subterranean formation. Unconsolidated subterranean zones may be stimulated by creating fractures in the zones and depositing particulate proppant material in the fractures to maintain them in open positions.

Gravel pack treatments with and without sand screens and the like have commonly been installed in wellbores penetrating unconsolidated zones to control sand production from a well. The gravel pack treatments serve as filters and help to assure that fines and sand do not migrate with produced fluids into the wellbore.

In a typical gravel pack completion, a screen consisting of screen units is placed in the wellbore within the zone to be completed. The screen is typically connected to a tool having a packer and a crossover. The tool is in turn connected to a work or production string. A particulate material, usually graded sand (often referred to in the art as gravel) is pumped in a slurry down the work or production string and through the crossover whereby it flows into the annulus between the screen and the wellbore. The liquid forming the slurry leaks off into the subterranean zone and/or through a screen sized to prevent the sand in the slurry from flowing there through. As a result, the sand is deposited in the annulus around the screen whereby it forms a gravel pack. The size of the sand in the gravel pack is selected such that it prevents formation fines and sand from flowing into the wellbore with produced fluids.

Circulation packing (sometimes called "conventional" gravel-packing) begins at the bottom of the screen and packs upward along the length of the screen. Gravel is transported into the annulus between the screen and casing (or the screen and the open hole) where it is packed into position from the bottom of the completion interval upward. The transport fluid then returns to the annulus through the washpipe inside the screen that is connected to the workstring.

After gravel packing it is sometimes necessary to perform additional and different treatments on the gravel packed zone after its production performance has been monitored and evaluated.

As pointed out above, when a well intersects multiple spaced formation zones, each zone may require separate or even different successive treatments. In these multiple zone wells, a need arises to mechanically isolate the separate zones so that they may be individually treated. In the selected gravel packing treatment example, a multiple zone well may require that each zone be isolated and connected to the surface and treated individually. For example, undesirable fluid losses and control problems could prevent simultaneous gravel packing of multiple zones. In addition, each zone may require unique treatment procedures and subsequent individual zone testing and treatment may be required.

Conventional methods of isolating individual zones for treatment, utilize multi-trip processes of setting temporary packers. The packers are first set, the isolated zone treated and the packers removed. To overcome these time consuming and expensive conventional methods one-time hydraulic operated sleeves have been used to provide access to a zone after it has first been treated. When the zone is to be opened the tools' hydraulically operated sleeve valve is opened as the well pressure is raised to a preset level and then bled off. These tools are one-shot in that they are installed in the closed position and once opened cannot be later closed to again isolate that particular zone. These prior systems and methods do not allow the zones to be selectively and repeatedly isolated for subsequent treatment and monitoring.

Thus, there are needs for improved methods and apparatus for completing wells, including providing a simple, cost-effective method and apparatus for individually and repeatedly isolating and treating multiple zones in a single well.

SUMMARY

The present invention provides improved methods and apparatus for isolating multiple hydrocarbon bearing zones in wells, including selectively and repeated isolation of individual zones in a well. More specifically, the present invention provides a zone isolation apparatus, which can be repeatedly opened and closed. This allows well zones to be selectively and individually treated or tested as may be required. This apparatus and method eliminates the costly and time consuming process of setting and removing packers each time the zone must be isolated.

The improved methods and apparatus basically comprise the steps of placing upper zone isolation apparatus on one or more of the zones of a well. In gravel packing the isolation apparatus is run in the well with the gravel pack-packer and screens and later opened and closed as required.

The improved methods and apparatus of the present invention, in one embodiment, utilizes a valve selectively providing fluid communication with a well zone isolated in an annulus between packers. The valve can be opened and closed by engaging and moving a sleeve accessible from the well surface through the well tubing. The valve is also remotely hydraulically actuateable by manipulating the downhole pressures.

Other and further objects, features and advantages of the present invention will be readily apparent to those skilled in the art upon a reading of the description of preferred embodiments which follows when taken in conjunction with the accompanying drawings, in which:

DETAILED DESCRIPTION OF THE INVENTION

The present invention provides improved methods and apparatus for completing, and separately treating separate hydrocarbon zones in a single well. The methods can be performed in either vertical or horizontal wellbores. The term "vertical wellbore" is used herein to mean the portion of a wellbore in a producing zone to be completed which is substantially vertical or deviated from vertical. The term "horizontal wellbore" is used herein to mean the portion of a wellbore in a subterranean producing zone, which is substantially horizontal, or at an angle from vertical. Since the present invention is applicable in vertical, horizontal and inclined wellbores, the terms "upper and lower," "top and bottom," as used herein are relative terms and are intended to apply to the respective positions within a particular wellbore while the term "levels" is meant to refer to respective spaced positions along the wellbore. The term "zone" is used herein to refer to separate parts of the well designated for treatment and includes an entire hydrocarbon formation or even separate portions of the same formation and horizontally and vertically spaced portions of the same formation. As used herein, "down", "downward", or "downhole" refer to the direction in or along the wellbore from the wellhead toward the producing zone regardless of whether the well bore's orientation is horizontal, toward the surface or away from the surface. So that the upper zone would be the first zone encountered by the wellbore and the lower zone would be located further along the wellbore. Tubing, tubular, casing, pipe liner and conduit are interchangeable terms used in the well field to refer to walled fluid conductors.

Figure 1:
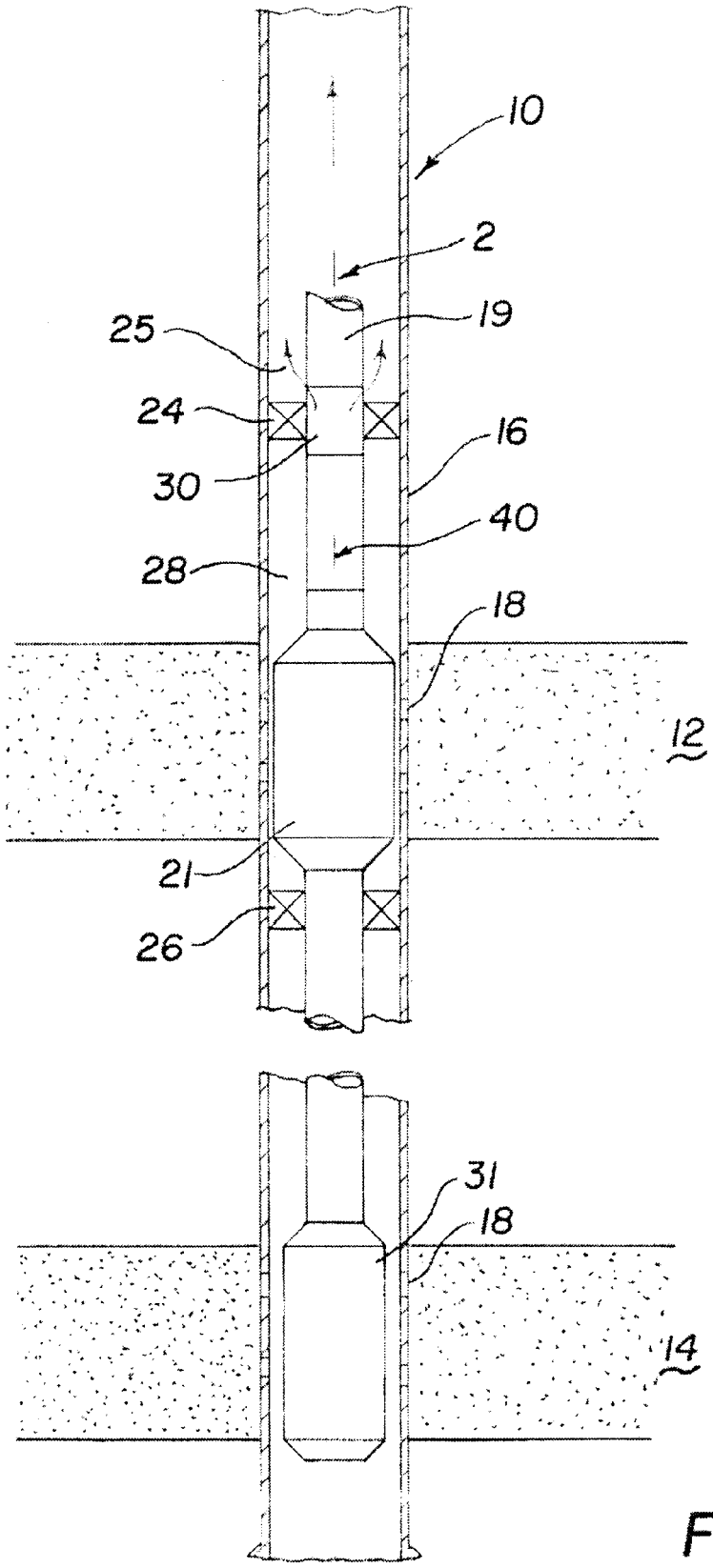
FIG. 1 is a schematic view illustrating a well screen assembly containing the zone isolation apparatus embodying principles of the present invention located in cased well adjacent to vertically separate subterranean zone to be treated.

Referring more particularly to the drawings wherein an embodiment of the present inventions is illustrated for purposes of example and wherein like reference characters are used throughout the several figures to represent like or corresponding parts, there is shown in FIG. 1 a cased wellbore generally designated by reference numeral 10. The wellbore 10 is illustrated intersecting two separate hydrocarbon bearing zones, upper zone 12 and lower zone 14. For purposes of description only two zones are shown, but it is understood that the present invention has application to isolate more than one well zone. As mentioned, while wellbore 10 is illustrated as a vertical cased well with two producing zones, the present invention is applicable to horizontal and inclined wellbores with more than two treatment zones and in uncased wells. In the illustrated embodiments arrow U indicates the uphole direction toward the wellhead. For purposes of explanation of the present invention the formations are to be treated by gravel packing but as previously discussed the present invention has application in other types of well treatments.

Upper and lower sand screen assemblies 21 and 31 are located inside the casing 16 of the wellbore 10 in the area of zones 12 and 14, respectively. Casing 16 is perforated at 18 to provide fluid flow paths between the casing and zones. Production tubing 19 is mounted in the casing 16. Conventional packers 24 and 26 and conventional crossover sub 30 seal or close the annulus 28 formed between the casing and sand screen assembly 21. The crossover 30 and packers 24 and 26 are conventional gravel pack forming tools and are well known to those skilled in the art.

According to the present invention, the illustrated gravel pack assembly includes the isolation tool 40 of the present invention. Tool 40 is illustrated in an exemplary down hole tool assembly for descriptive purposes but it is to be understood that the tool of the present invention has application in a variety of tool configurations. Expansion joint and the like although not illustrated could be included in the tool assembly as needed.

Tool 40 contains a first flow passageway connected to communicate with the lower screen assembly 31 and production tubing 19. A second flow passage in tool 40 communicates with the screen 21 and the annulus 25 above packer 24. Packers 24 and 26 and crossover 30 isolate the annulus 28 from the first flow passageway and the remainder of the well. Tool 40 functions to selectively isolate and connect sand screen 21 to annulus 25. Thus tool 40 selectively isolates the zone 12 from the remainder of the well and allows the zones 12 and 14 to be independently produced. According to the present invention, the tool 40 can be opened and closed by engaging a sleeve (not shown in FIG. 1) exposed in the first flow passageway of tool 40 or opened by raising and then lowering the pressure supplied to tool 40 from annulus 25. The tool 40 can be opened production tubing has been run into place.

Figure 2A:
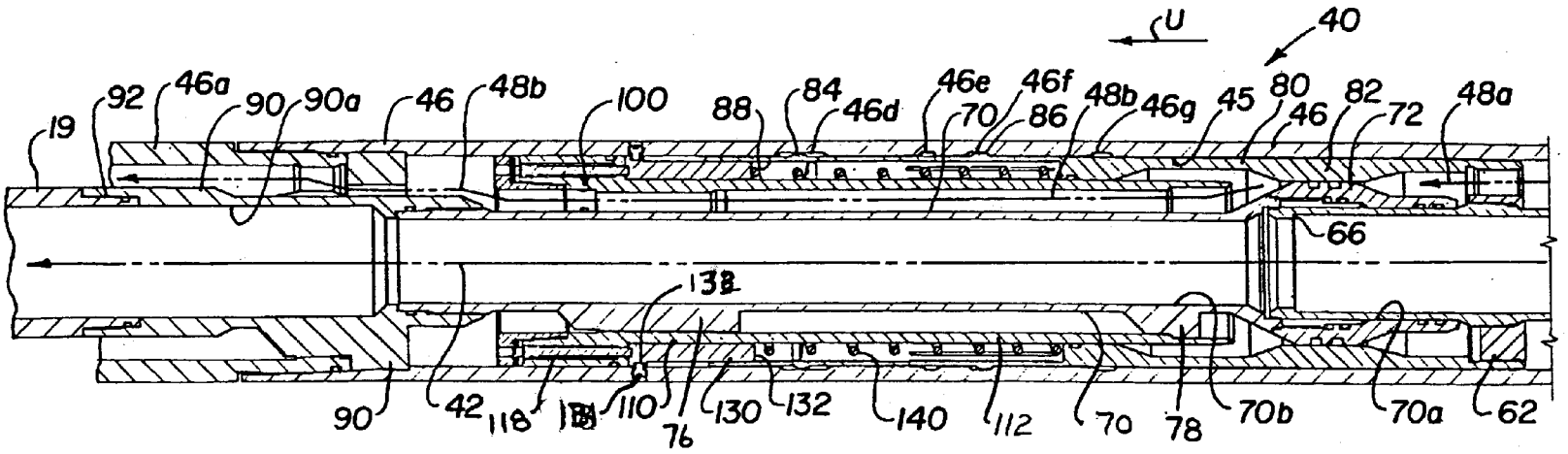
FIG. 2—is a longitudinal sectional view of one embodiment of the tool of the present invention illustrated in the closed or run position.
Figure 2B:
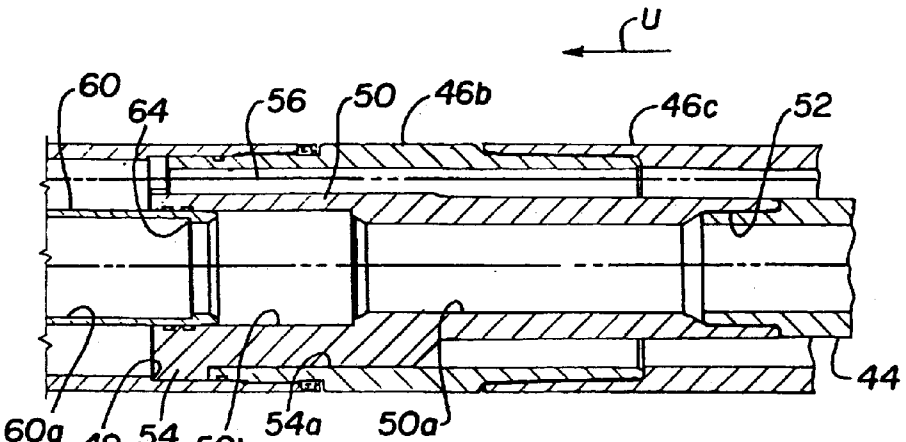
Figure 5:
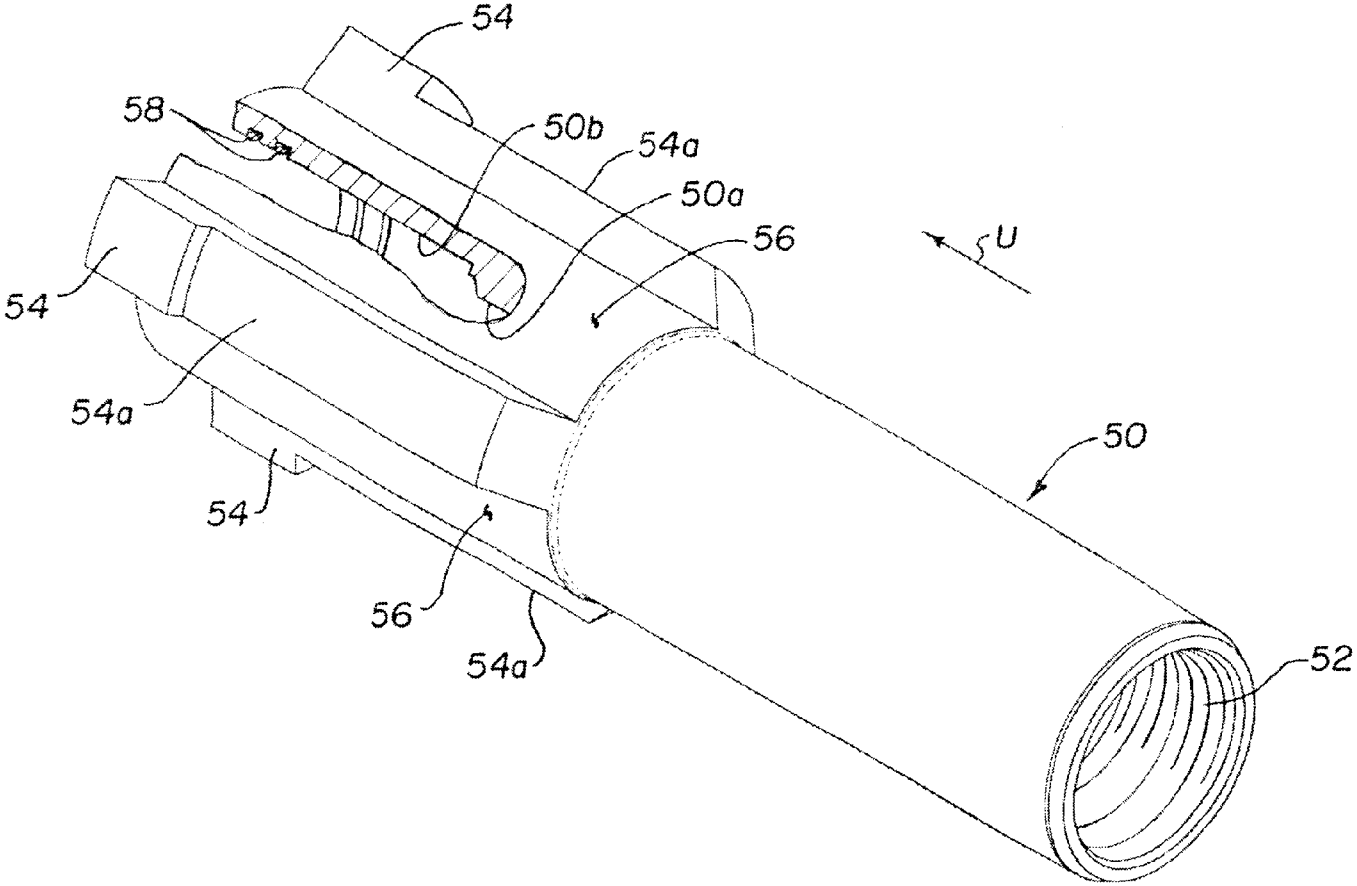
Figure 6:
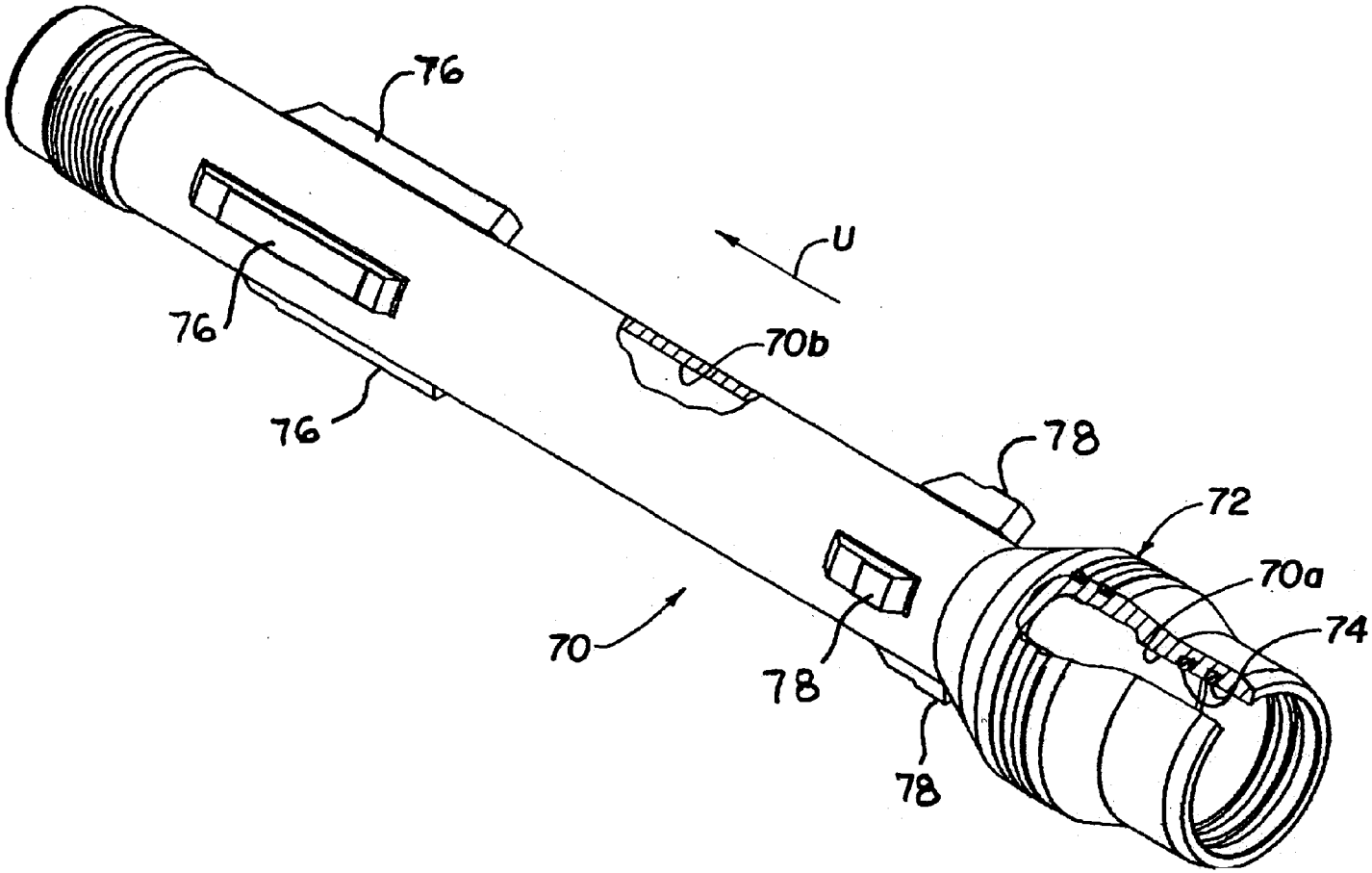
FIG. 6 is an enlarged perspective view of the spacer of the tool embodiment shown in FIGS. 2–5.

FIG. 2 illustrates in detail an embodiment of the tool 40. The previously referenced first flow passageway through tool 40 is a central passageway designated by elongated arrow 42. Arrow 42 points up hole or toward the wellhead. As previously described passageway 42 connects to tubing passing through lower packer 26 and connected to screen 31. Tubing 44 is threaded into threads 52 in the downhole end of the passageway 42 and communicates with the lower screen 31. Production tubing 19 is connected by threads 92 at the uphole end of passageway 42 and tubing 19 extends to the wellhead or an upper production packer (not shown). Passageway 42 extends completely through the housing 46 of tool 40 and is formed in part by internal passageways 50*a* and 50*b* in lower spacer 50, internal passageway 60*a* in movable sleeve 60, internal passageways 70*a* and 70*b* in valve seat mandrel 70 and internal passageway 90*a* in upper spacer 90. Spacer 50, mandrel 70 and sleeve 60 are shown in detail in FIGS. 5,6, and 7, respectively.

The previously referred to second fluid passageway is an annular passageway designated by elongated arrows 48*a* and *b* formed inside of housing 46. The upper end of housing 46 is connected by threads to tubing 46*a*. Tubing 46*a* is connected to annulus 25. The downhole end of housing 46 is connected by threads to adapter 46*b*. Adapter 46*b* retains the radially extending legs 54 on spacer 50 against shoulder 49 inside housing 46. The reduced diameter portions 54*a* of these legs fit inside adapter 46*b*. The axially extending spaces 56 between legs 54 form a portion of passageway 48*a*. Adapter 46*b* is coupled by threads to tubing 46*c*. Tubing 46*c* connects passageway 48*a* to the interior of screen 21. In FIG. 2, the tool 40 is in the run or closed position with the passageway 48*a* closed from 48*b* by the engagement between the annular valve 82 (on sleeve valve 80) and the seat 72 (on valve seat mandrel 70). As will be described the valve 82 can be moved away from the seat 72 to open passageway 48 through the tool 40. When the tool 40 is in the closed position (FIG. 2), the interior of screen 21 is closed from annulus 25 by valve 82 and seat 72. As will be described with reference to FIG. 4, when open (valve 82 separated axially from seat 72) fluid from inside screen flows into annulus 25 and to the wellhead (not shown).

Figure 7:
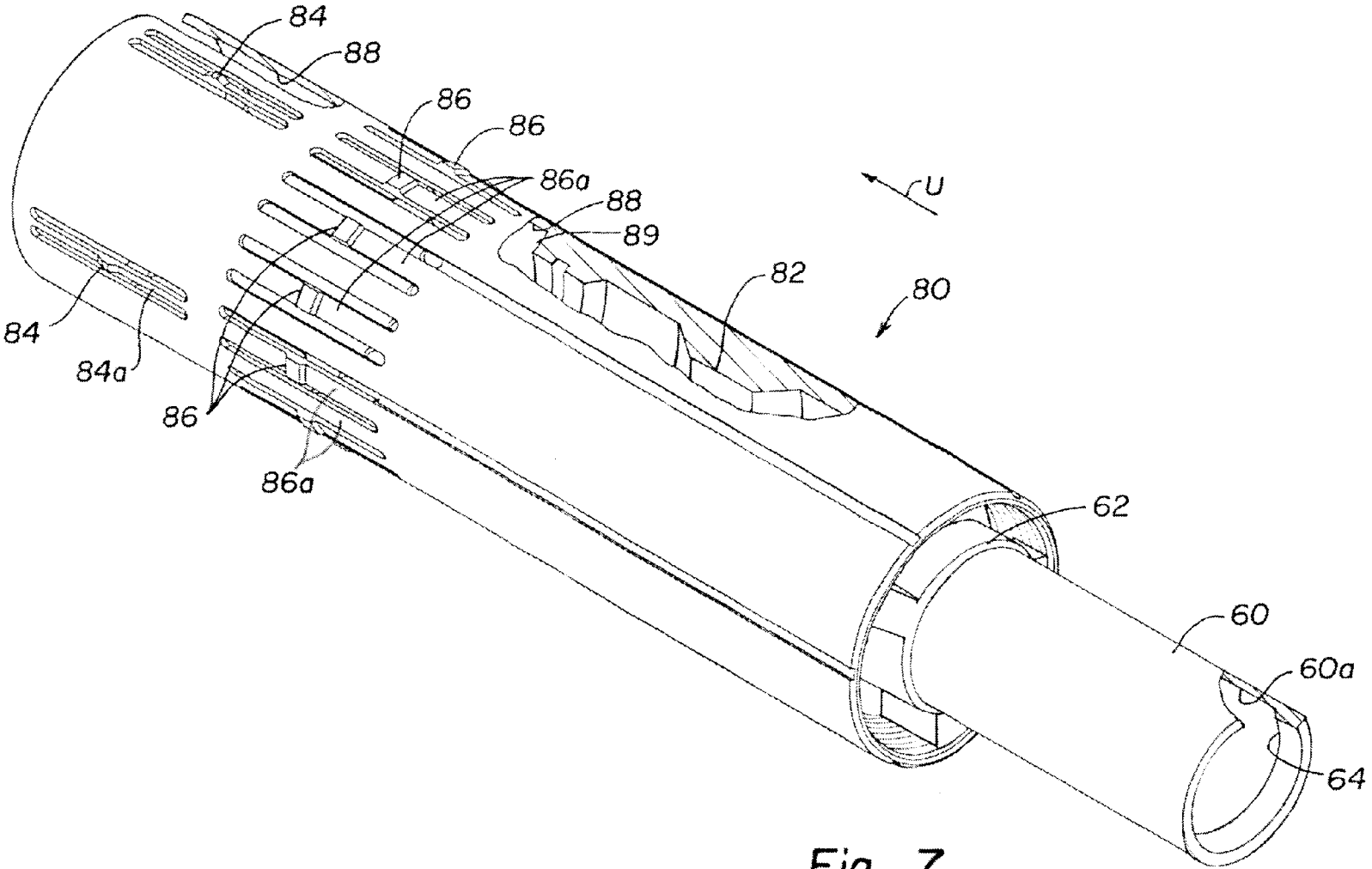
FIG. 7 is an enlarged perspective view of the valve seat mandrel of the tool embodiment shown in FIGS. 2–5.

The assembly of sleeve 60 and sleeve valve 80 is illustrated in FIG. 7. Sleeve 60 is connected by a spider ring 62 to the downhole end of sleeve valve 80. As illustrated in FIG. 2, the downhole end of sleeve 60 telescopes in passageway 50*b* of spacer 50. Suitable seals or packing 58 provide a sliding seal between the sleeve 60 and passageway 50*b* in spacer 50. The uphole end of sleeve 60 telescopes into the passageway 70*a* of valve seat mandrel 70. Suitable seals or packing 74 form a sliding seal between the sleeve 60 and passageway 70*a* of valve seat mandrel 70. Annular shoulders 64 and 66 are formed adjacent the ends of passageway 60*a*. These shoulders are exposed to the interior of the first flow passageway 42 and can be accessed through production tubing 19. Since the sleeve 60 is mechanically connected to the axially movable sleeve valve 80, the valve element 82 can be axially moved into and out of contact with the valve seat 72 buy engaging and axially moving one of the shoulders 64 or 66 on the sleeve 60. In this manner, a tool can be run through the tubing 19 to engage the shoulders to axially move the sleeve 60 and sleeve valve 80 to manually open or close the second passageway 48*a* and *b*.

As illustrated in FIG. 7, two sets of axially spaced lugs 84 and 86 are formed on the exterior of sleeve valve 80. Lug sets 84 and 86 are each positioned on radially compressible longitudinally extending springs 84*a* and 86*a*. These springs allow the lugs when forced radially inward to deflect the springs into the internal bore 45 of housing 46. Valve sleeve 80 is mounted to slide in the interior bore 45 of housing 46. According to a particular feature of the present invention, axially spaced annular grooves 46*d*, 46*e*, 46*f* and 46*g* are formed in the wall of bore 45. Lugs 84 and 86 are of a size and shape to engage or extend into these grooves. The springs 84*a* and 86*a* resiliently urge the lugs radially outward to latch in the grooves to temporarily locate the sleeve valve 80 in discrete axial positions. Moving the sleeve between the open and closed positions requires locking and unlocking the lug sets into and out of the grooves. Note that the axial force needed to latch and unlatch lugs 84 from the grooves is designed to be less than the force needed to unlatch lugs 86. This is accomplished by providing a larger number of lugs 86 on springs 86*a* that are stiffer. In the run position illustrated in FIG. 2, lugs 84 are located in slot 46*d* and lugs 86 are located in slot 46*f*.

According to the present invention, a hydraulically operated actuator assembly 100 is located in the tool to open the passageway 48 in response to a series of pressure variations applied to annulus 25. The hydraulic actuator assembly comprises cylinder-housing 110, actuator sleeve 130 and coil spring 140 all concentrically mounted around valve seat mandrel 70. Spring 140 is compressed between annular shoulder 89 and the downhole 132 end of sleeve 130. The force of spring 140 urges the valve seat mandrel 70 in a downhole direction to separate the valve element 82 from the seat 72. Spring 140 is designed to apply sufficient force to unlock or dislodge lugs 84 from slot 46*d* but insufficient force to unlock lugs 86 from slot 46*f*. In the run position the locking force of lugs 86 in slots 46*f* hold the valve in the closed position.

Actuator sleeve 130 is initially held in place by shear screws 131. In the illustrated embodiment a plurality of radially extending circumferentially spaced screws 131 are used. The screws are threaded into the housing 46 and extend into radially extending bores 133 in sleeve 130. When sufficient axial force is applied to sleeve 130, by pistons 118, pins 131 will shear allowing the sleeve to move axially from the position shown in FIG. 2 to the position shown in FIG. 3.

The hydraulic actuator cylinder-housing 110 comprises a cylindrical portion 112 of a size to extend through the spring 140 and is centered and supported from radially extending legs 76 and 78 on valve seat mandrel 70. The uphole end 114 of portion 112 has a plurality of circumferentially spaced axially extending bores 116 formed therein. Actuator pistons 118 are mounted to reciprocate in bores 116. Fluid input ports 120 communicate with the bores 116 and annulus 48*b*. Actuator pistons 118 extend through the ends of bores 116 to engage the uphole end of sleeve 130. When the pressure is raised in annulus 48*b* the pressure in bores 116 is in turn raised forcing pistons 118 against sleeve 130. When the force exerted by pistons 118 overcomes and shears screws 131, sleeve 130 moved axially in a downhole direction to the position shown in FIG. 3. As sleeve 130 is forced to move downhole an annular shoulder 134 on sleeve 130 engages the uphole facing end of end of sleeve valve 80 forcing the sleeve valve 80 to move to the position shown in FIG. 3 with lug 86 displaced from slot 46*f*. It is to be noted that the lug 84 is temporarily held in slot 46*e* by nose portion 138 of sleeve 130.

Figure 4:
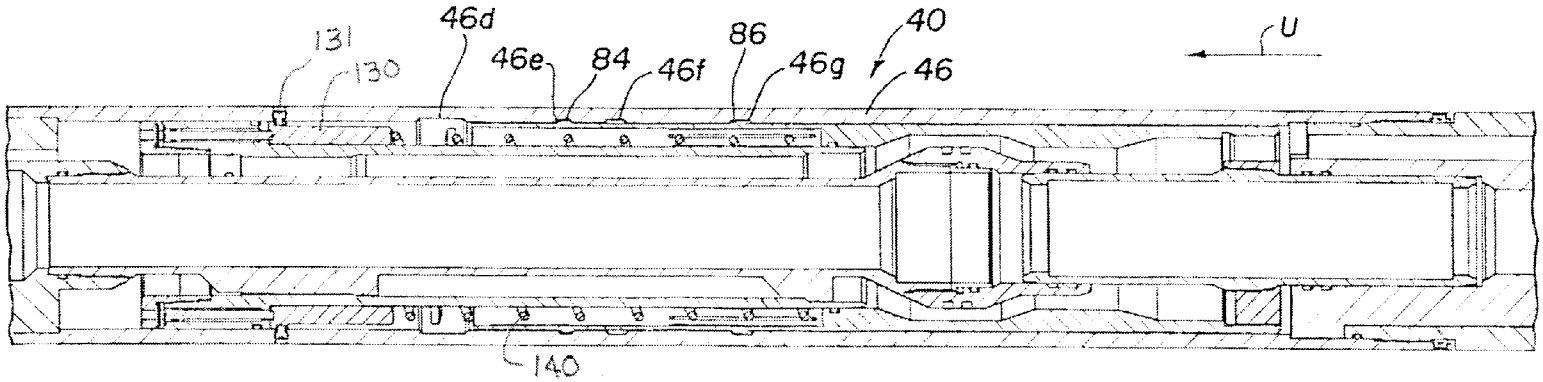
FIGS. 3–5 are views similar to FIG. 2 illustrating the tool embodiment of FIG. 2 in a sequence of tool positions occurring during opening of the tool.
Figure 3:
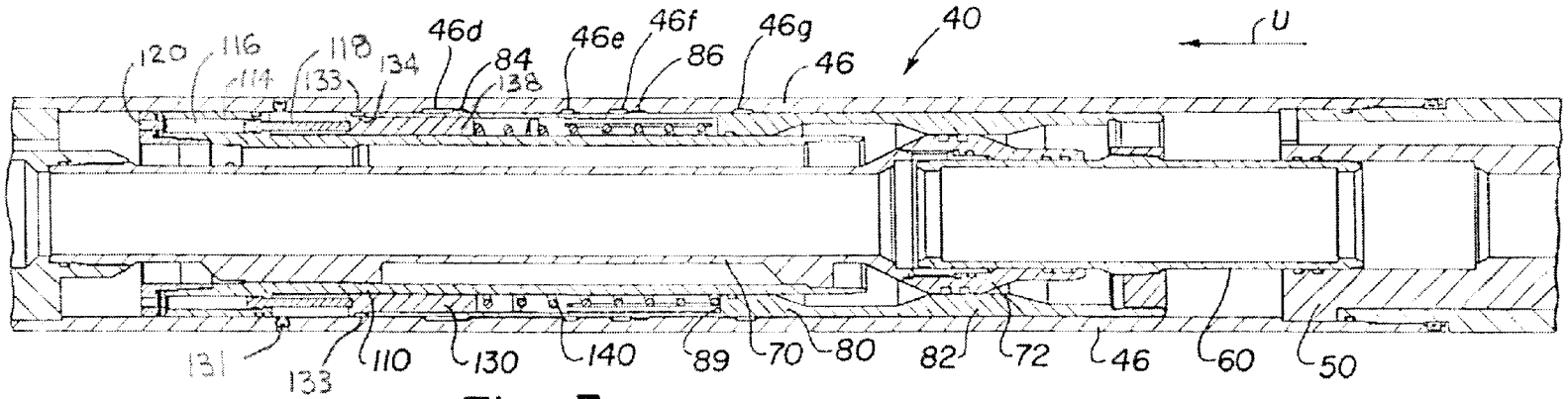

When the pressure in annulus 48*b* is lowered, spring 140 will cause sleeve 130 to move from the position shown in FIG. 3 to the position shown in FIG. 4. When the nose portion 138 has moved away from slot 46*d* and as previously pointed out spring 140 will cause lug 84 to be forced out of slot 46*d* allowing the sleeve valve to open by moving to the position shown in FIG. 4.

In operation during production, the isolation tool 40 is assembled in the closed position and is lowered into wellbore 10 on a completion assembly to a position adjacent formation 12. Packers 24 and 26 are set isolating the upper zone 12. The lower zone 14 is serviced as required while the upper zone is isolated. Access to the upper zone can be accomplished by raising and then lowering the pressure in the annulus 25, which causes the valve in tool 40 to open. The upper zone 12 can be opened or isolated as desired by lowering a tool through the production sting and engaging the internal shoulders 64 and 66 in tool 40 to mechanically open or close the valve as required.

Thus, the present invention is well adapted to carry out the objects and attain the ends and advantages mentioned as well as those, which are inherent therein. Of course, the invention does not require that all the advantageous features and all the advantages need to be incorporated into every embodiment of the invention. While numerous changes may be made by those skilled in the art, such changes are included in the spirit of this invention as defined by the appended claims. The invention is not limited to the specific structures and variations disclosed but will permit obvious variations within the scope of the invention as defined by the claims herein.

What is claimed is:

1. A remotely operable valve assembly for use in a subterranean well to selectively control flow in a first flow passageway formed in the annulus between an inner and an outer telescoped tubular members and a separate central flow passageway formed by the inner tubular member, the central passageway being of a size to allow well tools to enter and pass through the central passageway, the valve assembly comprising:

an annular valve and mating seat mounted in the annulus to control flow through the annulus;

the valve is mounted to be axially movable with respect to the seat between a closed position adjacent the seat where flow through the annulus is blocked and an open position axially displaced from the seat where flow through the annulus is not blocked;

a first valve actuator operably connected to move the valve between the open and closed positions in response to engagement by a well tool located in the central passageway, and a second valve actuator operably connected to the valve to axially move the valve from the closed position to the open position in response to a series of pressure variations in the annulus.

2. The valve assembly of claim 1 wherein the second actuator comprises a shiftable sleeve in the central passageway operably connected to move with the valve, a shoulder on the sleeve of a size and shape to allow well tools in the central passageway to engage the shoulder and axially move the sleeve to in turn move the valve between the open and closed positions.

3. The valve assembly of claim 1 wherein the first actuator comprises at least one piston mounted to telescope in a bore in the annulus in response to variations in pressure in the annulus.

4. The valve assembly of claim 1 additionally comprising a spring resiliently urging the valve to move toward the open position.

5. The valve assembly of claim 1 additionally comprising a latch operably associated with the valve to maintain the valve in the open or closed positions.

6. The valve assembly of claim 5 wherein the latch comprises a collet spring with lugs engaging recesses.

7. The valve assembly of claim 1 wherein the series of pressure variations comprises first raising the pressure in the annulus and then lowering the pressure in the annulus.

8. A well engaging a plurality of spaced subterranean hydrocarbon producing formation sections at speed location comprising:

tubular casing open at spaced locations to the formation sections;

a tubular member with a central passageway located in the casing at the location of at least one of the formation sections, the tubular member forming an annulus with the casing extending to one producing section;

seals preventing flow from the at least one section to the well; and an valve assembly comprising an annular valve and mating seat mounted in the annulus to control flow through the annulus;

the valve mounted to be axially movable with respect to the seat between a closed position adjacent the seat where flow through the annulus is blocked and an open position axially displaced from the seat where flow through the annulus is not blocked;

a first valve actuator operably connected to the valve to move the valve between the open and closed positions in response to engagement by a well tool located in the central passageway, and a second valve actuator operably connected to the valve to move the valve from the closed position to the open position in response to a series of pressure variations in the annulus.

9. The well of claim 8 wherein the series of pressure variations comprises first raising the pressure in the annulus and then lowering the pressure in the annulus.

10. The valve assembly of claim 8 wherein the second actuator comprises a shiftable sleeve in the central passageway operably connected to move with the valve, a shoulder on the sleeve of a size and shape to allow well tools in the central passageway to engage the shoulder and axially move the sleeve to in turn move the valve between the open and closed positions.

11. The valve assembly of claim 8 wherein the first actuator comprises at least one piston mounted to telescope in a bore in the annulus in response to variations in pressure in the annulus.

12. The valve assembly of claim 8 additionally comprising a spring resiliently urging the valve to move toward the open position.

13. The valve assembly of claim 8 additionally comprising a latch operably associated with the valve to maintain the valve assembly in the open or closed positions.

14. The valve assembly of claim 13 wherein the latch comprises a collet spring with lugs engaging recesses.

15. A method of producing hydrocarbons from a cased well having two spaced subterranean casing portions each open to receive hydrocarbons from the surrounding formation, the method comprising the steps of:

assembling on a tubing string at least two packers of a size to seal against the interior of the casing and a remotely operable valve assembly in fluid communication with the exterior of the tubing string;

lowering the tubing string to a point in the casing of the well where one of the hydrocarbon producing casing portions is located between the packers;

setting the packers to seal the annulus formed between the casing and tubing string;

closing the valve assembly to isolate the annulus and at least one hydrocarbon producing portion from the remainder of the well;

accessing through the tubing string the other hydrocarbon casing portion:

remotely opening the valve assembly by subjecting the valve to a series of pressure variations;

engaging the valve assembly through the tubing string to selectively open and close the valve to provide fluid access to the at least one hydrocarbon casing portion and to isolate the at least one hydrocarbon casing portion; and removing the hydrocarbons entering the well through the two spaced subterranean casing portions from the well.

16. The method of claim 15 wherein the valve assembly comprises an annular valve and mating seat mounted in the annulus to control flow through the annulus;

the valve is mounted to be axially movable with respect to the seat between a closed position adjacent the seat where flow through the annulus is blocked and an open position axially displaced form the seat where flow through the annulus is not blocked;

a first valve actuator operably connected to the valve to move the valve between the open and closed position in response to engagement by a well tool located in the tubing string, and a second valve actuator operably connected to the valve to move the valve from the closed to the open position in response to a series of pressure variations in the annulus.

17. The method of claim 15 wherein the well has additional spaced hydrocarbon producing casing portions.

18. The method of claim 16 wherein the first valve actuator comprises at least one piston mounted to telescope in a bore in the tubing string casing annulus in response to variations in pressure in the annulus.

19. The method of claim 15, the valve movable between an open and a closed position, additionally comprising a spring resiliently urging the valve to move toward the open position.

20. The method of claim 20 wherein the latch comprises a collet spring with lugs engaging recesses.

21. The method of claim 16 wherein valve assembly of claim 16 wherein the latch comprises a collet spring with lugs engaging recesses.

22. The method of claim 16 wherein the series of pressure variations comprises first raising the pressure in the annulus and then lowering the pressure in the annulus.

23. The method of claim 16 wherein the second actuator comprises a shiftable sleeve in the central passageway operably connected to move with the valve, a shoulder on the sleeve of a size and shape to allow well tools in the central passageway to engage the shoulder and axially move the sleeve to in turn move the valve between the open and closed positions.

24. The method of claim 16 wherein the first actuator comprises at least one piston mounted to telescope in a bore in the annulus in response to variations in pressure in the annulus.

* * * * *